United States Patent [19]

Penner

[11] Patent Number: 4,762,115

[45] Date of Patent: Aug. 9, 1988

[54] DRAFT PLUGGING DEVICE FOR A CHIMNEY FLUE

[76] Inventor: Peter Penner, 19 Thornbury Crescent, Winnipeg Manitoba, Canada, R2G 3B2

[21] Appl. No.: 81,092

[22] Filed: Aug. 3, 1987

[51] Int. Cl.[4] ..... F23J 13/08

[52] U.S. Cl. ..... 126/319; 126/120; 138/93

[58] Field of Search ..... 126/285 R, 286, 288, 126/319, 120, 121; 138/89, 93, 89.1; 98/1, 59; 137/1, 75; 277/34

[56] References Cited

U.S. PATENT DOCUMENTS

| | | | |
|---|---|---|---|
| 3,038,732 | 6/1962 | Scott et al. | 277/34 |
| 3,232,207 | 2/1966 | Gibbons | 138/93 |
| 3,592,207 | 7/1971 | Borello | 98/1 |
| 3,981,317 | 9/1976 | Strulik et al. | 98/1 |
| 3,990,464 | 11/1976 | Jenkins | 138/93 |
| 4,015,587 | 4/1977 | Wincek | 126/286 |
| 4,029,128 | 6/1977 | Yamagishi | 138/89 |
| 4,194,494 | 3/1980 | Wagner | 126/319 |
| 4,256,130 | 3/1981 | Smith et al. | 137/1 |
| 4,398,565 | 8/1983 | Williamson | 138/93 |
| 4,512,356 | 4/1985 | Widerby | 137/75 |
| 4,565,222 | 1/1986 | Lundman | 138/93 |
| 4,596,234 | 6/1986 | Cates | 126/288 |
| 4,649,896 | 3/1987 | Formosa | 126/319 |

FOREIGN PATENT DOCUMENTS

| | | | |
|---|---|---|---|
| 583938 | 9/1959 | Canada . | |
| 762272 | 7/1967 | Canada . | |
| 1033312 | 6/1978 | Canada . | |
| 412676 | 7/1934 | United Kingdom | 138/93 |

OTHER PUBLICATIONS

Elastomers Notebook (Dec. 57) p. 571.

*Primary Examiner*—James C. Yeung
*Attorney, Agent, or Firm*—Adrian D. Battison; Stanley G. Ade

[57] ABSTRACT

A device for plugging a chimney flue when not in use comprises an elongate semi-rigid wand which can be manoeuvered by manual moving of one end so that the opposed end can be inserted into the chimney flue. The opposed end carries an inflatable balloon which can be inflated to grasp the inner surface of the flue by valve arrangement at the lower end.

4 Claims, 1 Drawing Sheet

DRAFT PLUGGING DEVICE FOR A CHIMNEY FLUE

BACKGROUND OF THE INVENTION

This invention relates to a draft plugging device for a chimney flue of a fireplace.

The chimney flue of a fireplace can in many circumstances act to generate significant air flow into or out of a building when the flue is not in use. In some cases, depending upon conditions, warm air rises within the flue so as to generate an air flow out of the flue thus drawing warm air out of the building and hence cold air must enter the building at some other location. In other cases, cold air can pass down the flue to enter the building through the fireplace.

Various proposals have been made to attempt to seal off or reduce this airflow including fireplaces which include doors, various actuation devices which are mechanically moved to close the flue and including the conventional damper which to some extend closes the flue but not sufficiently to prevent air flow.

These devices have generally not been successful and there remains in many cases a serious problem of air flow particularly in cold climates. Mechanical devices which are actuated to close the flue at the upper end, while they may be relatively successful in reducing the air flow, can freeze up and thus prevent the device from being reopened for further use of the flue when the fireplace has a fire.

It is one object of the present invention, therefore, to provide an improved device for plugging a chimney flue.

According to the invention, therefore, there is provided a device for plugging a chimney flue of a fireplace to prevent air movement through the flue when the flue is not in use, the device comprising an elongate hollow wand, an inflatable body mounted on one end of the wand so as to be inflatable by air supplied through the hollow wand from a collapsed condition to an expanded condition in which it can engage an inner periphery of the flue, and a valve member provided on an opposed end of the wand and arranged such that inflation air can be supplied through the valve from an inflation device and such that the valve member can be closed to prevent escape of inflation air from said wand, the wand being formed from a material having properties such that said one end and inflatable body can be supported and manoeuvered by manual movement of said opposed end and such that it can flex sufficiently to pass from the fireplace into the flue.

According to a second aspect of the invention, there is provided a method for plugging a chimney flue of a fireplace to prevent air movement through the flue when the flue is not in use, the method comprising inserting into the flue an elongate hollow wand by manual movement of the wand grasped at one end thereof, said wand having on an opposed end thereof an inflatable body arranged so as to be inflatable by air supplied through the hollow wand and having a valve member on said one end of said hollow wand, supplying inflation air through said hollow wand to said inflatable body so as to expand from a collapsed condition to an expanded condition in which it engages an inner periphery of the flue, said valve member being arranged to prevent escape of the inflation air from said wand, the wand being formed from material having properties such that said opposed end and said inflatable body can be supported and manoeuvered by manual movement of said one end and such that it can flex sufficiently to pass from the fireplace into the flue.

The device can therefore simply be manually inserted into the chimney flue and inflated either by a separate pump which is attached to the valve assembly or by an integral hand pump on the end of the wand remote from the inflatable balloon.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
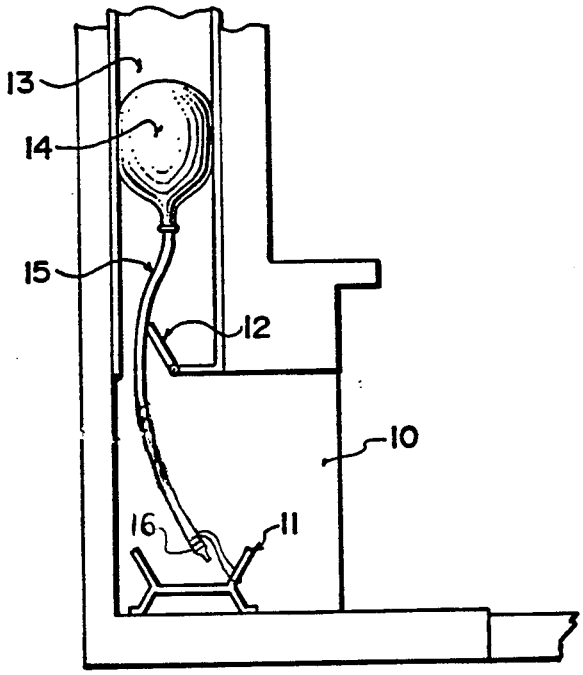
FIG. 1 is a schematic side elevational view of a chimney, flue and a device according to the invention in place in the flue providing a plug against air movement through the flue.
Figure 2:
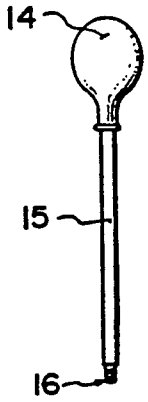
FIG. 2 is a side elevational view of the device of FIG. 1.
Figure 4:
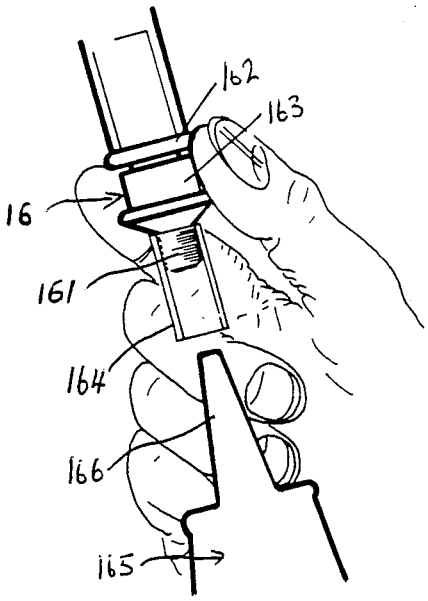
FIG. 4 is a side elevational view of the valve area of the device of FIG. 1.

A fireplace is shown schematically in FIG. 1 as an open type fireplace having a fire box 10, rack 11 for the burning material, damper 12 and flue 13. This construction is of course entirely conventional and in many cases the open fire box or fireplace is closed by simple doors or by a metal construction inserted into the fireplace. The invention is also applicable to stoves which are intended to be airtight and which are connected to a simple flue extending from the stove to an outlet.

Figure 3:
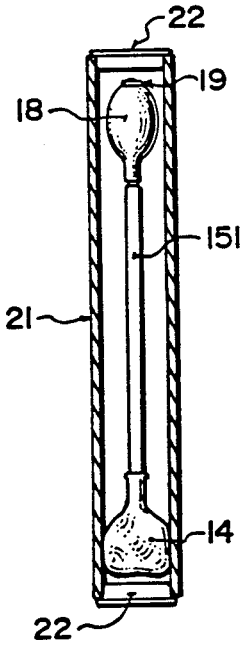
FIG. 3 is a view partly in cross-section and partly in side elevation showing a second embodiment of the invention positioned within a storage container.

The invention comprises an inflatable balloon or body 14 which is mounted on one end of a semi-rigid tube 15. The balloon or bladder can be formed as an integral part of the tube or it can be merely mounted on the end of the tube and held there by suitable means such as adhesive or a binding. In a collapsed condition of the balloon it is generally not self-supporting and of similar transverse dimension to the tube 15. A lower end of the tube 15 carries a valve 16 which as shown in FIG. 3 is of the type including an internal valve mechanism and an outer screw threaded sleeve 161 by which the valve can be attached to an inflation pump of a type suitable for vehicle tires. Again the valve can be formed as an integral part of the tube or can be a separate item attached to the tube as a press fit therein.

The valve 16 includes a fixed seat 162 attached to the tube and a manually slideable portion 163 which can be moved axially away from the tube to open the seat and allow inflation or deflation. A sliding movement toward the tube seals the valve against deflation. A flexible tube part 164 of smaller cross-section can be attached over the screwthreaded for cooperation with a pump 165 having a nozzle 166.

The valve can also be of the type in which an integrally moulded cap or a tab can be snap fitted onto a cylindrical receptacle to act as a seal for the hollow wand.

The material of the tube is such that it is sufficiently rigid so that it can be grasped at the lower end and can act as a wand which is thus self-supporting and allows the upper end to be manoeuvered by manual movement of the lower end. However, the tube is slightly flexible in order that it can accommodate any necessary deviations to pass from the fireplace into the flue or from the outside into the fireplace as may be required in an initial movement.

A lower end of the tube 15 may carry a visually apparent flag which hangs down into the fireplace to indicate to a potential user of the fireplace that the device is in place in the flue. The flag may merely be a coloured rectangle or could include warning notice.

In the embodiment as shown in FIG. 1 however, the length of the tube is sufficient to extend to the grate, i.e., a length of the order of 4½ feet. In addition the tube is formed of a bright coloured material to be immediately visible to any potential users.

A loop 17 of for example elastic is attached to the device at the valve end so that it can be hooked over the grate to prevent any up-drafts carrying the device up the chimney when it is insufficiently inflated to firmly grasp the chimney wall.

In any event it has been determined that use of a simple thin-skinned balloon does not cause problem even if a fire is lit with the device in place since the balloon will merely explode and allow the tube to fall back into the fireplace without causing any damage to the fireplace or to the building, although of course the device itself may be destroyed. However, the device is of a very simple nature and accordingly can be manufactured cheaply, and the bladder can be replaced.

The balloon when inflated engages the inner surface of the flue and accordingly provides a very effective seal which has been found to be better than any metal closure. In addition the balloon cannot freeze up within the flue in the very coldest weather by condensation which can deposit on the device and thus tend to freeze it closed. Furthermore the air trapped within the balloonacts as an insulation between warm air on the underside of the balloon and cold air above the balloon and thus inhibits or prevents ice buildup in the chimney due to condensation.

The device can also be used during summer months to prevent the entry of insects and similar contaminants from entering the building through the open flue.

FIG. 3 shows an alternative arrangement of the device which is for use as an integral item without the necessity for a separate inflation pump. In this case a hand-operated bulb is permanently attaced to the tube 151, the bulb being indicated at 18. In this case a one-way valve 19 allows the bulb to be pumped by hand to cause inflation of the balloon shown in collapsed condition at 20. The device is mounted within a tubular container 21 with an end cap 22 in which it may be supplied. The container 21 allows the device to be removed from the flue after use when it may be severly soiled and placed into a container so that it can be kept adjacent the fireplace but without causing any soiling to the surrounding decorations.

The bladder or balloon is in one embodiment simply spherical in form when inflated. In another embodiment for use with square cross-section chimneys, the bladder can be formed or molded with shaping to enter more easily the required rectangular shape when inflated.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed:

1. A device for plugging a chimney flue of a fireplace to prevent air movement through the flue when the flue is not in use, the device comprising straight elongate, semi-rigid hollow wand, an inflatable body mounted on one end of the wand so as to be inflatable by air supplied through the hollow wand from a collapsed condition to an expanded condition in which it can engage an inner periphery of the flue, a valve member provided on an opposed end of the wand and arranged such that inflation air can be supplied through the valve member from an inflation device and such that the valve member can be closed to prevent escape of inflation air from said wand, the wand being formed from a material having properties such that said one end an inflatable body can be supported and manoeuvered by manual movement of said opposed end and such that it can flex sufficiently to pass from the fireplace into the flue, and being formed from bright coloured material so as to be readily visually apparent at said opposed end when observed by a user from a position outside of said fireplace, said inflatable body being collapsible to a condition in which it is not self-supporting and is not substantially larger than the transverse dimension of the wand, and an elongate container having a length and transverse dimension sufficient to receive the hollow wand, inflatable body and valve member such that the device can stored when removed from the flue in a soiled condition.

2. The invention according to claim 1 including a loop member attached to said wand at said opposed end thereof.

3. The invention according to claim 1 wherein said valve member includes a valve seat portion and a manually actuable valve portion moveable toward and away from the wand.

4. A method for plugging a chimney flue of a fireplace to prevent air movement through the flue when the flue is not in use, the method comprising inserting into the flue a straight, elongate semi-rigid hollow wand by manual movement of the wand grasped at one end thereof including flexing the wand sufficiently such that it can pass from the fireplace into the flue past a damper, said wand having on an opposed end thereof an inflatable body which is collapsed to a condition in which it is not self supporting and is not substantially larger than the transverse dimension of the wand, supplying inflation air through said hollow wand to said inflatable body so as to expand the body from the collapsed condition to an expanded condition in which it engages an inner periphery of the flue, and preventing escape of the inflation air from said wand, the wand being formed from material having properties such that said opposed end and said inflatable body can be supported and manoeuvered by manual movement of said one end and such that it can flex sufficiently to pass from the fireplace into the flue.

* * * * *